US007954354B2

(12) United States Patent
Myers et al.

(10) Patent No.: US 7,954,354 B2
(45) Date of Patent: Jun. 7, 2011

(54) METHOD OF MANUFACTURING CONTAINERS

(75) Inventors: Gary L. Myers, Sarver, PA (US); Anthony J. Fedusa, Lower Burrell, PA (US); Robert E. Dick, Cheswick, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 11/768,267

(22) Filed: Jun. 26, 2007

(65) Prior Publication Data

US 2008/0022746 A1 Jan. 31, 2008

Related U.S. Application Data

(63) Continuation-in-part of application No. 11/474,581, filed on Jun. 26, 2006, now Pat. No. 7,934,410.

(51) Int. Cl.
*B21D 9/00* (2006.01)
*B21D 51/00* (2006.01)

(52) U.S. Cl. ..... 72/379.4; 72/348; 72/715; 413/76

(58) Field of Classification Search ..... 72/379.4, 72/348, 370.06, 370.1, 370.11, 370.12, 370.13, 72/352, 355.4, 356, 715; 413/69, 76
See application file for complete search history.

(56) References Cited

U.S. PATENT DOCUMENTS 3,759,205 A * 9/1973 Dolveck ..... 72/370.02
3,857,917 A 12/1974 Reade
3,898,828 A 8/1975 Cassai et al.
3,995,572 A 12/1976 Saunders
4,163,380 A 8/1979 Masoner
4,173,883 A 11/1979 Boik
4,947,667 A 8/1990 Gunkel et al.
5,040,682 A 8/1991 Palisin, Jr. et al.
5,058,408 A 10/1991 Leftault, Jr. et al.
5,160,031 A 11/1992 Palisin, Jr. et al.
5,261,558 A 11/1993 Claydon
5,351,852 A 10/1994 Trageser et al.
5,355,710 A 10/1994 Diekhoff
5,394,727 A 3/1995 Diekhoff et al.
5,470,405 A 11/1995 Wyatt-Mair et al.
5,487,295 A 1/1996 Diekhoff et al.
5,522,248 A 6/1996 Diekhoff et al.
5,572,893 A 11/1996 Goda et al.
5,645,190 A 7/1997 Goldberg
5,699,932 A 12/1997 Claydon et al.
(Continued)

FOREIGN PATENT DOCUMENTS

AR 060964 10/2010
(Continued)

OTHER PUBLICATIONS

Office Action from related U.S. Appl. No. 11/474,581 dated Apr. 24, 2009.

(Continued)

*Primary Examiner* — Debra M Sullivan
(74) *Attorney, Agent, or Firm* — Greenberg Traurig LLP

(57) ABSTRACT

A method for manufacturing containers including providing a container having a first diameter; expanding the diameter of the container to a second diameter with at least one expansion die is disclosed. Expansion dies can be used to expand the diameter of a container. Multiple expansion dies can be used to gradually expand the diameter of the container without significantly damaging the container. The container can then be formed to accept a closure.

35 Claims, 10 Drawing Sheets

U.S. PATENT DOCUMENTS

| | | | | |
|---|---|---|---|---|
| 5,711,178 | A | 1/1998 | Hogendoorn et al. | |
| 5,713,235 | A | 2/1998 | Diekhoff | |
| 5,724,848 | A | 3/1998 | Aschberger | |
| 5,727,414 | A * | 3/1998 | Halasz et al. | 72/348 |
| 5,746,080 | A | 5/1998 | Hartman et al. | |
| 5,755,130 | A | 5/1998 | Tung et al. | |
| 5,776,270 | A | 7/1998 | Biondich | |
| 5,822,843 | A | 10/1998 | Diekhoff et al. | |
| 5,832,766 | A | 11/1998 | Hartman et al. | |
| 5,851,685 | A | 12/1998 | McEldowney | |
| 5,899,104 | A | 5/1999 | Brilman et al. | |
| 5,899,105 | A | 5/1999 | Erhard | |
| 5,899,106 | A | 5/1999 | Heurteboust et al. | |
| 5,902,086 | A | 5/1999 | Enoki | |
| 5,916,317 | A | 6/1999 | Willoughby et al. | |
| 5,938,389 | A | 8/1999 | Shore et al. | |
| 5,960,659 | A | 10/1999 | Hartman et al. | |
| 5,970,767 | A | 10/1999 | Hartman et al. | |
| 6,038,910 | A * | 3/2000 | McClung | 72/348 |
| 6,079,244 | A | 6/2000 | Robinson et al. | |
| 6,085,563 | A | 7/2000 | Heiberger et al. | |
| 6,112,932 | A | 9/2000 | Holdren | |
| D435,454 | S | 12/2000 | Munn et al. | |
| 6,250,122 | B1 | 6/2001 | Robinson et al. | |
| 6,286,357 | B1 * | 9/2001 | D'Amore et al. | 72/379.4 |
| 6,308,545 | B2 | 10/2001 | Burgel et al. | |
| 6,338,263 | B1 | 1/2002 | Obata et al. | |
| 6,343,496 | B1 | 2/2002 | Hanna et al. | |
| D455,961 | S | 4/2002 | Edson et al. | |
| 6,374,657 | B1 | 4/2002 | Kirk et al. | |
| 6,442,991 | B1 * | 9/2002 | Rojek | 72/352 |
| D464,264 | S | 10/2002 | Edson et al. | |
| 6,701,764 | B2 | 3/2004 | Bruck et al. | |
| D490,317 | S | 5/2004 | Chang | |
| 6,779,677 | B2 | 8/2004 | Chupak | |
| 6,802,196 | B2 | 10/2004 | Gong et al. | |
| 6,886,722 | B2 | 5/2005 | Flecheux | |
| 6,907,653 | B2 | 6/2005 | Chupak | |
| 6,945,085 | B1 | 9/2005 | Goda | |
| D512,315 | S | 12/2005 | Holm | |
| D514,937 | S | 2/2006 | Chang | |
| 7,003,999 | B2 | 2/2006 | Campo et al. | |
| 7,004,000 | B2 | 2/2006 | Campo et al. | |
| 7,188,499 | B2 | 3/2007 | Ogaki et al. | |
| 7,670,094 | B2 | 3/2010 | Boltshauser | |
| 7,726,165 | B2 | 6/2010 | Myers et al. | |
| 2001/0022103 | A1 | 9/2001 | Zeiter et al. | |
| 2001/0040167 | A1 | 11/2001 | Flecheux et al. | |
| 2002/0162371 | A1 | 11/2002 | Hamstra et al. | |
| 2003/0074946 | A1 | 4/2003 | Campo et al. | |
| 2003/0102278 | A1 | 6/2003 | Chupak | |
| 2003/0115923 | A1 | 6/2003 | Veen et al. | |
| 2004/0011112 | A1 | 1/2004 | Lentz et al. | |
| 2004/0035871 | A1 | 2/2004 | Chupak | |
| 2004/0040970 | A1 | 3/2004 | Weijers et al. | |
| 2004/0187536 | A1 | 9/2004 | Gong et al. | |
| 2004/0194522 | A1 | 10/2004 | Hamstra et al. | |
| 2004/0216506 | A1 | 11/2004 | Simpson et al. | |
| 2004/0231395 | A1 * | 11/2004 | Barber | 72/370.06 |
| 2005/0000260 | A1 | 1/2005 | Campo et al. | |
| 2005/0193796 | A1 | 9/2005 | Heiberger et al. | |
| 2005/0235726 | A1 | 10/2005 | Chupak | |
| 2006/0071035 | A1 | 4/2006 | Christ et al. | |
| 2007/0266758 | A1 | 11/2007 | Myers et al. | |
| 2007/0271993 | A1 | 11/2007 | Druesne et al. | |
| 2007/0295051 | A1 | 12/2007 | Myers et al. | |
| 2008/0116212 | A1 | 5/2008 | Jonker | |
| 2009/0274957 | A1 | 11/2009 | Goda et al. | |
| 2010/0199741 | A1 | 8/2010 | Myers et al. | |

FOREIGN PATENT DOCUMENTS

| | | |
|---|---|---|
| AU | 2007254362 | 12/2010 |
| CL | 1699-96 | 9/1996 |
| CL | 2206-96 | 11/1996 |
| CL | 2234-96 | 12/1996 |
| CL | 2418-99 | 10/1999 |
| CL | 2846-00 | 10/2000 |
| CL | 0440-2005 | 3/2005 |
| DE | 4113428 | 10/1992 |
| EP | 492861 | 7/1992 |
| EP | 599583 | 6/1994 |
| EP | 721384 | 8/1994 |
| EP | 767241 | 4/1997 |
| EP | 845315 | 6/1998 |
| EP | 852973 | 7/1998 |
| EP | 852974 | 7/1998 |
| EP | 854823 | 7/1998 |
| EP | 1064413 | 1/2001 |
| EP | 0853513 | 8/2001 |
| EP | 928229 | 8/2001 |
| EP | 0853514 | 10/2001 |
| EP | 0853515 | 10/2001 |
| EP | 1294622 | 3/2003 |
| EP | 1506824 | 2/2005 |
| EP | 1461262 | 2/2007 |
| EP | 1586393 | 9/2007 |
| EP | 2111935 | 10/2009 |
| FR | 2495507 | 6/1982 |
| FR | 2762383 | 10/1998 |
| ID | P0026760 | 10/2010 |
| JP | 07242226 | 9/1995 |
| JP | 2000015371 | 1/2000 |
| WO | 91/11274 | 8/1991 |
| WO | 91/11275 | 8/1991 |
| WO | 91/14626 | 10/1991 |
| WO | 93/22079 | 11/1993 |
| WO | 95/05253 | 2/1995 |
| WO | 95/15227 | 6/1995 |
| WO | 96/15865 | 5/1996 |
| WO | 96/25256 | 8/1996 |
| WO | WO96/40457 | 12/1996 |
| WO | 97/11889 | 4/1997 |
| WO | 97/12704 | 4/1997 |
| WO | 97/12705 | 4/1997 |
| WO | 97/12706 | 4/1997 |
| WO | 97/47408 | 12/1997 |
| WO | 98/05445 | 2/1998 |
| WO | 98/39117 | 9/1998 |
| WO | 98/43757 | 10/1998 |
| WO | 99/32242 | 7/1999 |
| WO | 99/37826 | 7/1999 |
| WO | 01/51231 | 7/2001 |
| WO | 01/58618 | 8/2001 |
| WO | 01/96209 | 12/2001 |
| WO | 03/039975 | 5/2003 |
| WO | 03/047991 | 6/2003 |
| WO | 2004/058597 | 7/2004 |
| WO | 2005000498 | 1/2005 |
| WO | 2005/099926 | 10/2005 |
| WO | 2006/040116 | 4/2006 |
| WO | 2006/078690 | 7/2006 |
| WO | 2008/110679 | 9/2008 |
| WO | 2009/130034 | 10/2009 |
| ZA | 2008/10096 | 12/2009 |

OTHER PUBLICATIONS

U.S. Office Action dated Mar. 17, 2008 from U.S. Appl. No. 11/474,581.

U.S. Office Action dated Oct. 9, 2008 from U.S. Appl. No. 11/474,581.

U.S. Office Action dated Apr. 24, 2009 from U.S. Appl. No. 11/474,581.

U.S. Office Action dated Apr. 17, 2007 from U.S. Appl. No. 11/383,515.

U.S. Office Action dated Sep. 5, 2007 from U.S. Appl. No. 11/383,515.

U.S. Office Action dated Apr. 28, 2008 from U.S. Appl. No. 11/383,515.

U.S. Office Action dated Dec. 29, 2008 from U.S. Appl. No. 11/383,515.

U.S. Office Action dated Jul. 21, 2009 from U.S. Appl. No. 11/383,515.

Malaysian Office Action dated Sep. 4, 2009 from Malaysian Application No. PI 20085325.

Chilean Office Action dated Feb. 13, 2009 from Chilean Application No. 1401-07.
European Office Action dated Jan. 8, 2010 from European Application No. 07 777 035.2.
Chinese Office Action dated Jan. 22, 1010 from Chinese Application No. 200780024250.7.
Chinese Office Action dated Jan. 22, 2010 from Chinese Application No. 200780023916.7.
Chilean Office Action dated Feb. 13, 2009 from Chilean Application No. 1401-07 with complete English translation.
U.S. Office Action dated Nov. 23, 2009 from U.S. Appl. No. 11/474,581.
Chinese Office Action dated Feb. 12, 2010 from Chinese Application No. 200780024186.2.
Malaysian Office Action dated Nov. 13, 2009 from Malaysian Application No. PI 20085324.
Eurasian Office Action dated Dec. 15, 2009 from Eurasian Application No. 200870536/30.
Egyptian Office Action dated Mar. 16, 2010 from Egyptian Application No. 2008/12/2088 with English translation.
Australian Office Action dated Mar. 31, 2010 from Australian Application No. 2007254362.
U.S. Office Action dated Sep. 1, 2010 from U.S. Appl. No. 12/767,190.
Indonesian Office Action dated Mar. 22, 2010 from Indonesian Application No. W-00200804206.
Canadian Office Action dated Apr. 7, 2010 from Canadian Application No. 2651778.
Canadian Office Action dated Apr. 13, 2010 from Canadian Application No. 2655908.
Canadian Office Action dated Apr. 15, 2010 from Canadian Application No. 2655925.
Indonesian Office Action dated Apr. 16, 2010 from Indonesian Application No. W-00200803711.
New Zealand Office Action dated Apr. 30, 2010 from New Zealand Application No. 573303.
European Office Action dated May 5, 2010 from European Application No. 07799029.9.
European Office Action dated May 5, 2010 from European Application No. 07797928.4.
Australian Office Action dated May 10, 2010 from Australian Application No. 2007265132.
Australian Office Action dated May 10, 2010 from Australian Application No. 2007265347.
Egyptian Office Action dated Jun. 2, 2010 from Egyptian Application No. 2008/122030.
New Zealand Office Action from corresponding New Zealand Application No. 574204 dated Jun. 17, 2010.
New Zealand Office Action from corresponding New Zealand Application No. 574797 dated Jun. 17, 2010.

* cited by examiner

SCALE 1x

SCALE 2x

SECTION A-A

SCALE 2x

MATERIAL : ALUMINUM

FINISH : 32 UNLESS NOTED

NOTE : BREAK ALL SHARP CORNERS

SCALE 1x

MATERIAL : ALUMINUM
FINISH : 32 UNLESS NOTED
NOTE : BREAK ALL SHARP CORNERS

METHOD OF MANUFACTURING CONTAINERS

This application is a continuation-in-part of U.S. patent application Ser. No. 11/474,581, filed Jun. 26, 2006, now U.S. Pat. No. 7,934,410 which is hereby incorporated by reference in its entirety.

BACKGROUND OF THE INVENTION

In the container industry, substantially identically shaped beverage containers are produced massively and relatively economically.

SUMMARY OF THE INVENTION

A method for manufacturing a container comprising: providing a container having a diameter X; and expanding the diameter of the container to Y with at least one expansion die is disclosed. In some embodiments, Y is more than 8% greater than X. In some embodiments, the container wall is substantially straight. In some embodiments, the diameter Y of the container wall is substantially uniform. In some embodiments, an end of the container is formed to accept a closure. In some embodiments, the diameter of the wall proximate to the end of the container is narrowed to W. In some embodiments the narrowing of the wall comprises die necking. In some embodiments, the die necking is performed without a knockout. In other embodiments, a knockout can be used. In some embodiments, expanding the diameter of the container with at least one expansion die comprises expanding the diameter of the container with multiple expansion dies. In some embodiments, the method for manufacturing further comprising expanding the diameter of the container to Z. In some embodiments, Z is more than 20% greater than X. In some embodiments, expanding the diameter of the container is part of an automated process.

BRIEF DESCRIPTION OF THE DRAWINGS

The following description, given by way of example and not intended to limit the invention solely thereto, will best be appreciated in conjunction with the accompanying drawings, wherein like reference numerals denote like elements and parts, in which.

DESCRIPTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

In one embodiment of the invention, a method of manufacturing a container comprises providing a container having a diameter X and expanding the diameter of the container to Y with at least one expansion die. In some embodiments, the container is further expanded to a diameter Z with at least one other expansion die.

Embodiments of the invention may be used in conjunction with any container capable of being expanded including but not limited to beverage, aerosol, and food containers. The container provided may be manufactured via any suitable means, including, but not limited to, drawing, draw reverse draw, drawing and ironing, drawing and stretching, deep drawing, 2-piece seamed and impact extrusion. In some embodiments, the container is comprised of aluminum or steel. In some embodiments, the aluminum comprises an alloy, such as Aluminum Association 3104, 3004, 5042, 1060, 1070, steel alloys may also be used. In some embodiments, the alloy has a hard temper, such as H19 or H39. In other embodiments, a softer temper metal is used.

Figure 1:
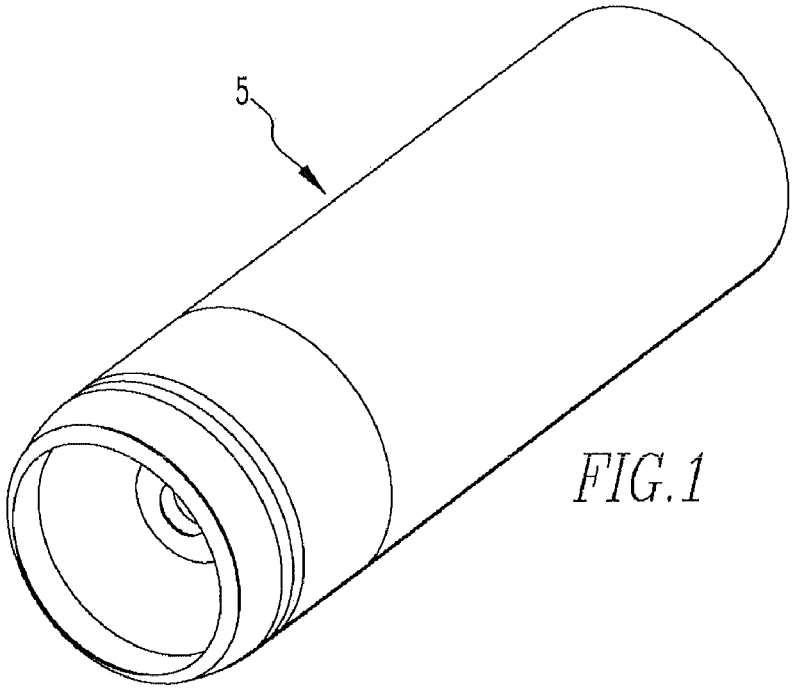
FIG. 1 is a perspective view of one embodiment of an expansion die used to expand a 2.087" diameter container to a 2.247" diameter container, in accordance with one embodiment of the present invention.
Figure 2:
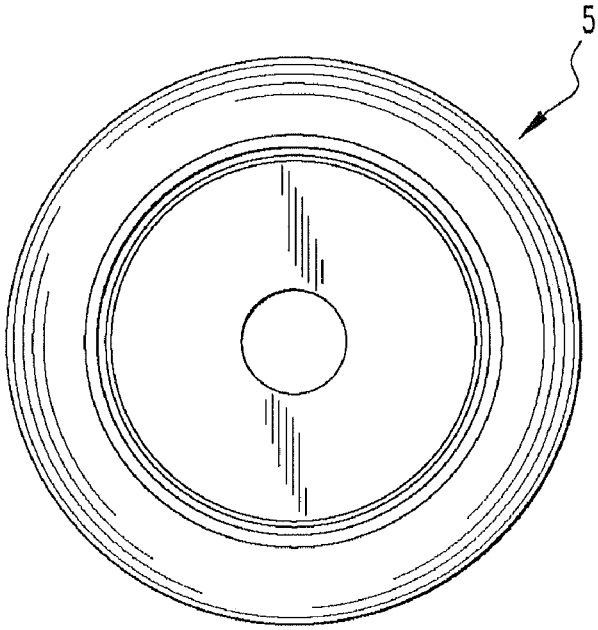
FIG. 2 is a top view of the expansion die of FIG. 1 showing line A-A.
Figure 3:
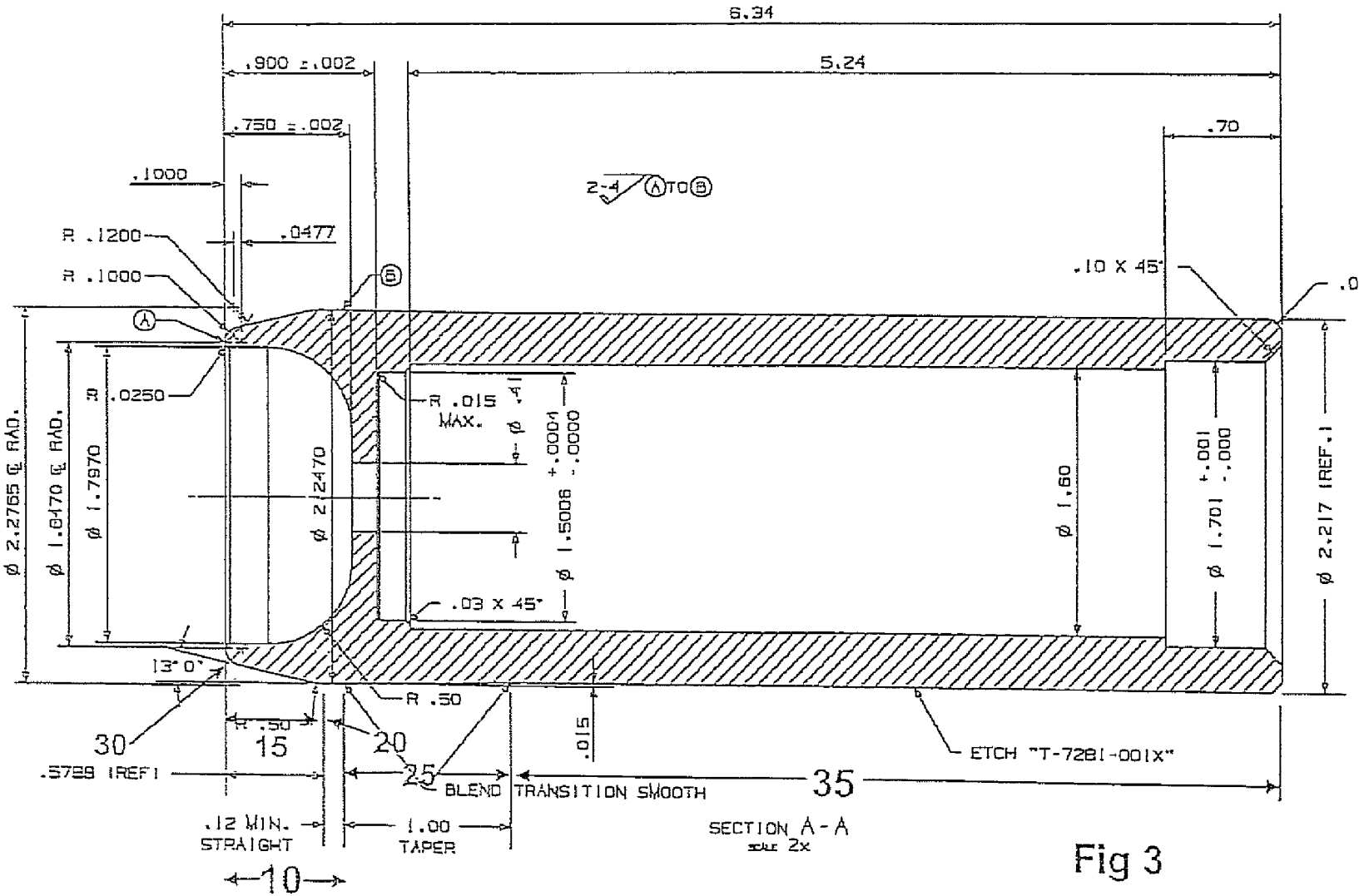
FIG. 3 is a cross-sectional view of the expansion die of FIGS. 1 and 2 along line A-A.
Figure 4:
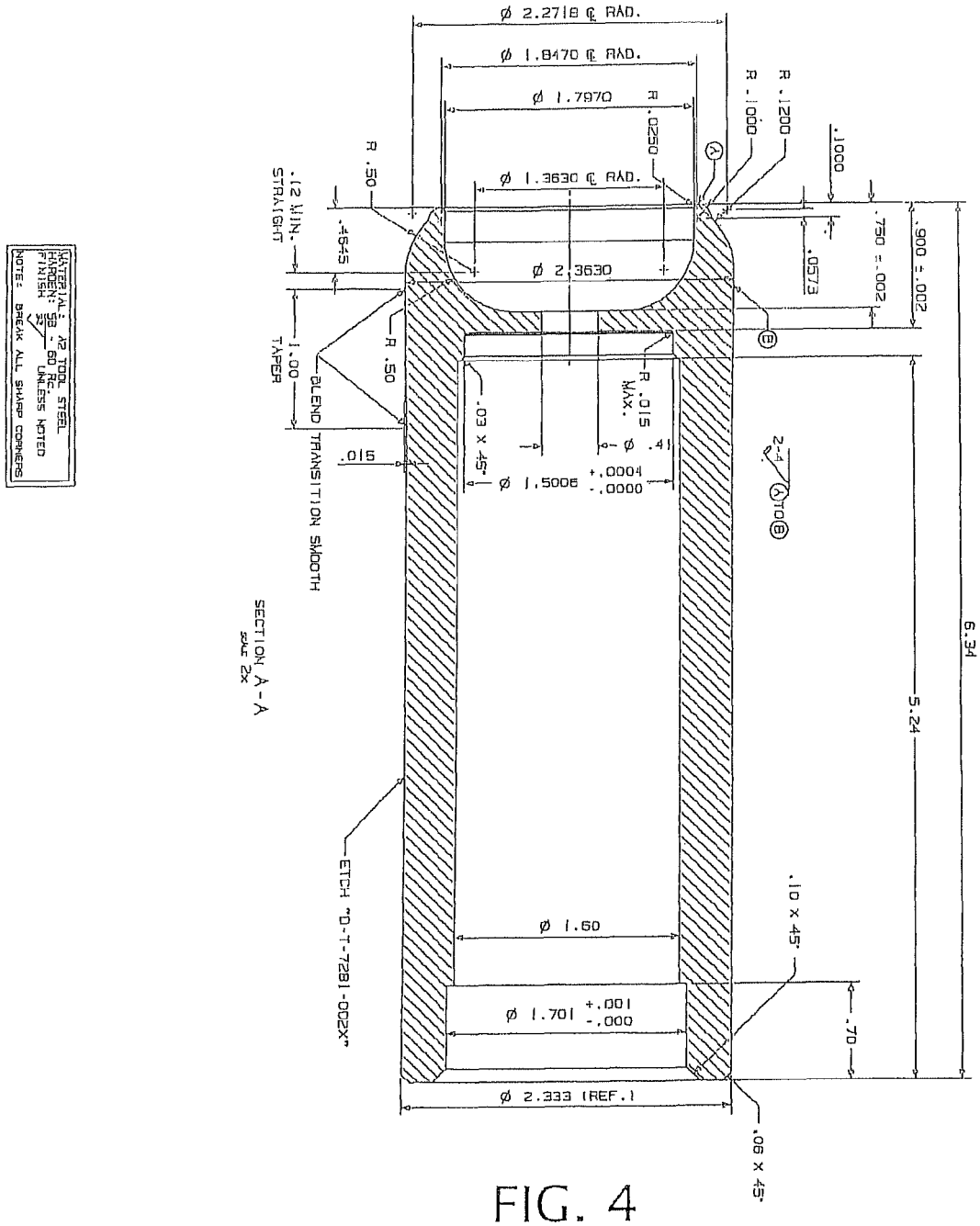
FIG. 4 is a cross-sectional view of an expansion die used to expand a 2.247" diameter container to a 2.363" diameter container according to one embodiment of the invention.
Figure 5:
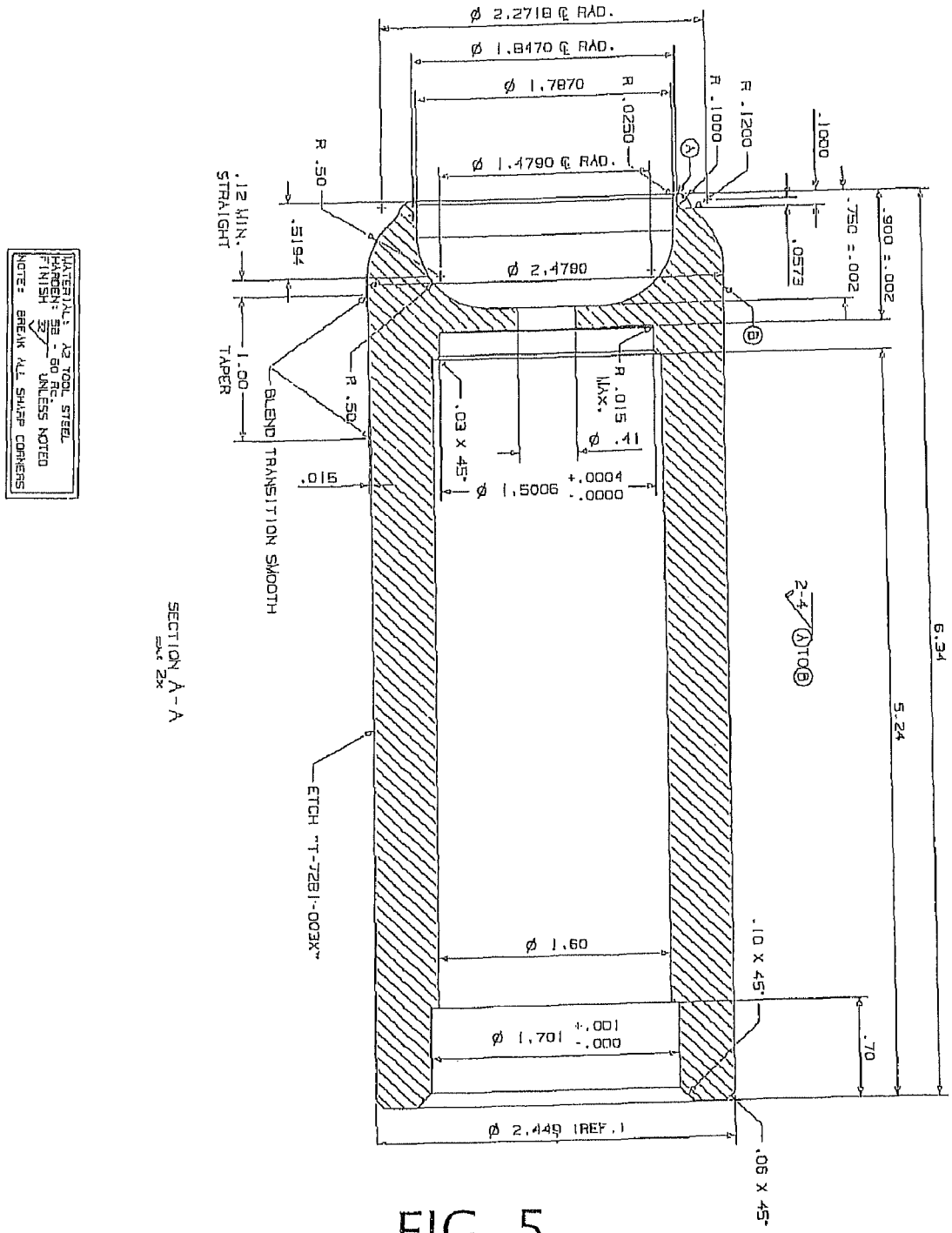
FIG. 5 is a cross-sectional view of an expansion die which can be used to expand a 2.363" diameter container to a 2.479" diameter container.
Figure 6:
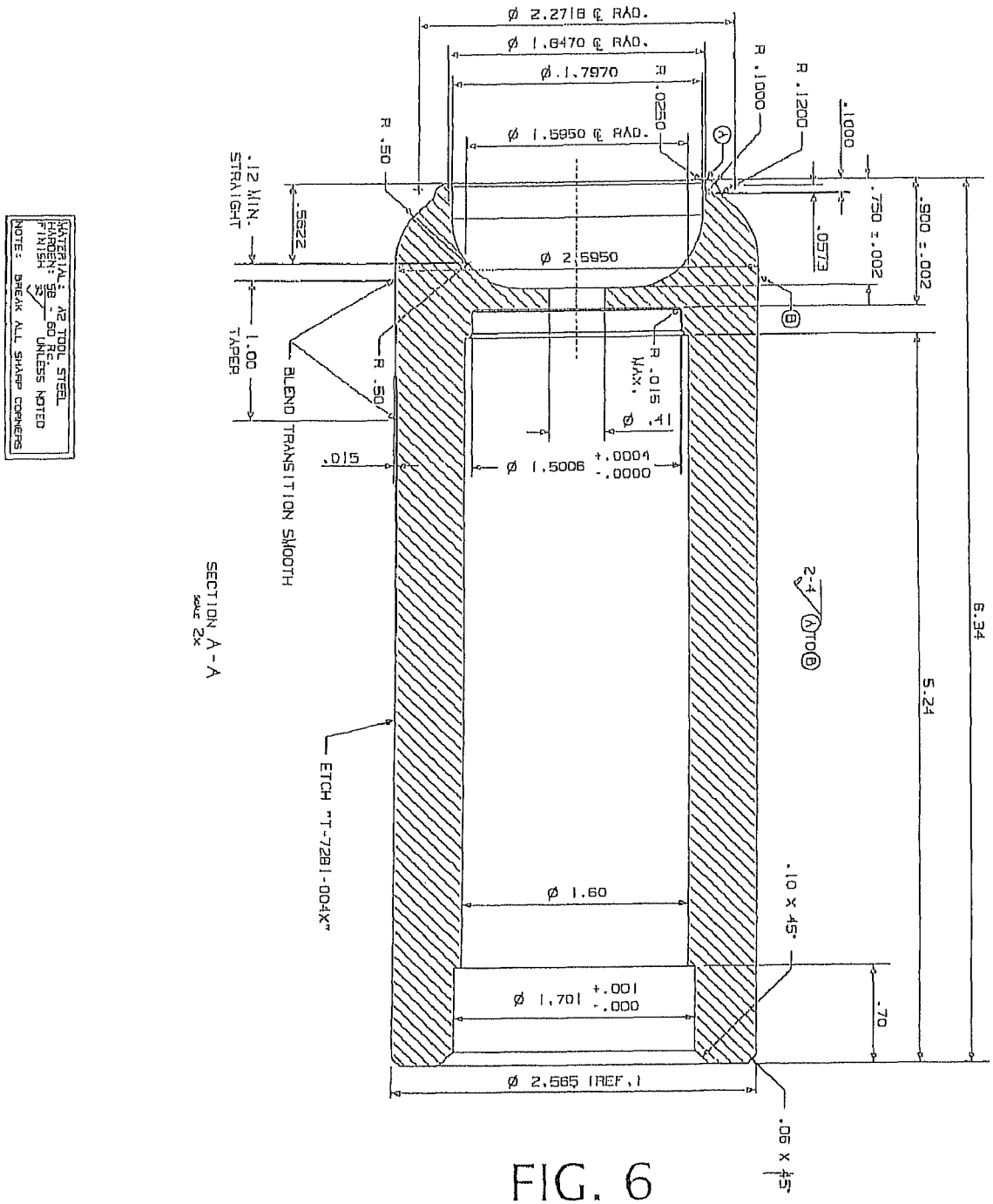
FIG. 6 is a cross-sectional view of an expansion die which can be used to expand a 2.479" diameter container to a 2.595" diameter container.

In some embodiments, at least one expansion die 5, an example of which is shown in FIGS. 1-3, is inserted into an open end of the container to expand the diameter of the container from X to Y. Another expansion die can be inserted into the open end of the container to expand the diameter of the container from Y to Z. This process can be repeated until the desired container diameter is achieved. FIGS. 3-6 show a set of expansion dies used to expand a 2.087" diameter container to a 2.595" diameter container. The four stages of expansion of the container can be seen in FIGS. 8-10.

A gradual expansion of a container comprised of a hard temper alloy using multiple expansion dies of increasing diameters, as opposed to using one expansion die, allows the diameter of the container to be expanded up to about 25% without fracturing, wrinkling, buckling or otherwise damaging the metal comprising the container 70. When expanding a container constructed of a softer alloy, it may be possible to expand the container 25% using one expansion die. The number of expansion dies 5 used to expand a container 70 to a desired diameter without significantly damaging the container is dependent on the degree of expansion desired, the material of the container, the hardness of the material of the container, and the sidewall thickness of the container. For example, the higher the degree of expansion desired, the larger the number of expansion dies required. Similarly, if the metal comprising the container has a hard temper, a larger number of expansion dies will be required as compared to expanding a container comprised of a softer metal the same degree. Also, the thinner the sidewall 80, the greater number of expansion dies will be required. Progressive expansion using a series of expansion dies may provide increases in the container's 70 diameter on the order of 25%, wherein greater expansions have been contemplated, so long as the metal is not significantly damaged during expansion. In some embodiments, the diameter of the container 70 is expanded more than 8%. In other embodiments the diameter of the container is expanded less than 8%, greater than 10%, greater than 15%, greater than 20%, greater than 25%, or greater than 40%. Other percentages of expansion are contemplated and are within the scope of some embodiments of the invention.

Further, when expanding a coated container, a gradual expansion will help to maintain the integrity of the coating. Alternatively, a container may be expanded before coating.

In some embodiments, the method of forming a container 70 further includes forming the open end of the container to accept a closure. Forming the open end of the container 70 to accept a closure can comprise narrowing the diameter of the sidewall 80 proximate to the open end of the container to W. The diameter W may be less than, equal to, or greater than diameter X. The narrowing can be accomplished via die necking, spin necking or any suitable method. In some embodiments, forming the open end of the container to accept a closure does not include narrowing the diameter of the sidewall.

In one embodiment, the necking process is accomplished using at least one necking die. Any suitable necking die known in the art may be used. In one embodiment, the container 70 is necked to form a beverage can. In another embodiment the container 70 is necked to form a beverage container having a bottle shape.

Necking all expanded container 70 formed in accordance with some embodiments of the invention to a diameter greater than or equal to the container's original diameter X does not require the use of a knockout because the container's sidewall 80 is in a state of tension following expansion. In some embodiments, a knockout can be used when necking the container.

In some embodiments, the sidewall 80 of the container 70 is substantially straight meaning the sidewall has no curves and is substantially uniform in diameter. The sidewall 80 is defined as the wall of the container 70 between the lower body area 90 and the necked in portion of the container, or, if the container is not necked in, between the lower body area 90 and the top 95 of the container. In some embodiments, the container is not necked in or otherwise narrowed. In some embodiments, a top portion of the container 70 is necked in to accept a closure. In some embodiments, the sidewall is substantially straight and of a substantially uniform diameter, but not completely straight or uniform in diameter, because the thickness of the metal comprising the sidewall may vary. In other embodiments, the sidewall 80 may be curved and the container 70 may have varying diameters.

In some embodiments, following the final expansion or necking step, the open end of the container 70 is formed to accept a closure. The forming step for attaching a closure to the open end of the container may be any known process or method, including, but not limited to, forming a flange, curl, thread, lug, attach an outsert and hem, or combinations thereof. Any suitable closure may be used, including but not limited to, standard double-seamed end, full-panel easy-open food end, crown closure, plastic threaded closure, roll-on pilfer proof closure, lug cap, aerosol valve, or crimp closure.

Referring again to FIGS. 1-3, in some embodiments, the die is comprised of A2 tool steel, 58-60 Rc harden, 32 finish, although any suitable die material may be used. In some embodiments, the expansion die 5 includes a work surface 10, having a progressively expanding portion 15, a land portion 20, and a tapered portion 25 transitioning to an undercut portion 35. An initial portion 30 of the work surface 10 in the depicted embodiment has a geometry for gradually transitioning the diameter of the container 70 sidewall 80. The progressively expanding portion 15 has dimensions and a geometry that when inserted into the open end of a container 70 works the container's sidewall 80 to radially expand the container's diameter in a progressive manner as the container travels along the work surface 10. In some embodiments, the expansion die 5 provides the appropriate expansion and forming operations without the need of a knockout or like structure. In some embodiments, a knockout may be used.

The land portion 20 has dimensions and a geometry for setting the final diameter of the container being formed by that expansion die 5. The tapered portion 25 transitions from the land portion 20 to the undercut portion 35. The undercut portion 35 extending at least the length of the container being expanded to enable the die to maintain control of the metal as it expands and to minimize the container becoming out-of-round. It is noted that the dimensions for the land portion 20, the undercut portion 35, and the tapered portion 25 are provided for illustrative purposes only and are not deemed to limit the invention, since other dimensions for the land portion 20 have also been contemplated and are within the scope of the disclosure.

The work surface 10 may be a polished surface or a non-polished surface. In one embodiment, a polished surface has a surface roughness average (Ra) finish ranging from 2 μin to 6 μin. In one embodiment, the work surface 10 may be a non-polished surface having a surface roughness average (Ra) finish ranging from more than or equal to 8 μin to less than or equal to 32 μin, so long as the non-polished work surface 10 does not significantly degrade the product side coating disposed along the container's inner surface.

In some embodiments, immediately following the land portion 20 the surface of the expansion die 5 tapers, forming a tapered portion 25 that transitions to all undercut portion 35 in order to reduce the frictional contact between the container 70 and the expansion die 5, as the container has been worked through the progressive expanding portion 15 and land portion 20 of the work surface 10. The reduced frictional contact minimizes the incidence of collapse and improves stripping of the container 70 during the expansion process. In some embodiments, the undercut portion 35 is a non-polished surface having a surface roughness average (Ra) finish ranging from more than or equal to 8 μin to less than or equal to 32 μin. The undercut portion 35 may extend into the expansion die wall by a dimension L of at least 0.005 inches preferably at least 0.015 inches. It is noted that the dimensions and surface roughness values for the undercut portion 35 are for illustrative purposes only and that the present invention is not deemed to be limited thereto.

A die system for producing containers is provided including the expansion die 5. The die system includes at least a first expansion die 5 having a work surface 10 configured to increase a container's diameter, and at least one progressive expansion die, wherein each successive die in the series of progressive expansion dies has a work surface configured to provide an increasing degree of expansion in the container's diameter from the previous expansion die. In one embodiment, the die system may also include one or more necking dies.

Figure 10:
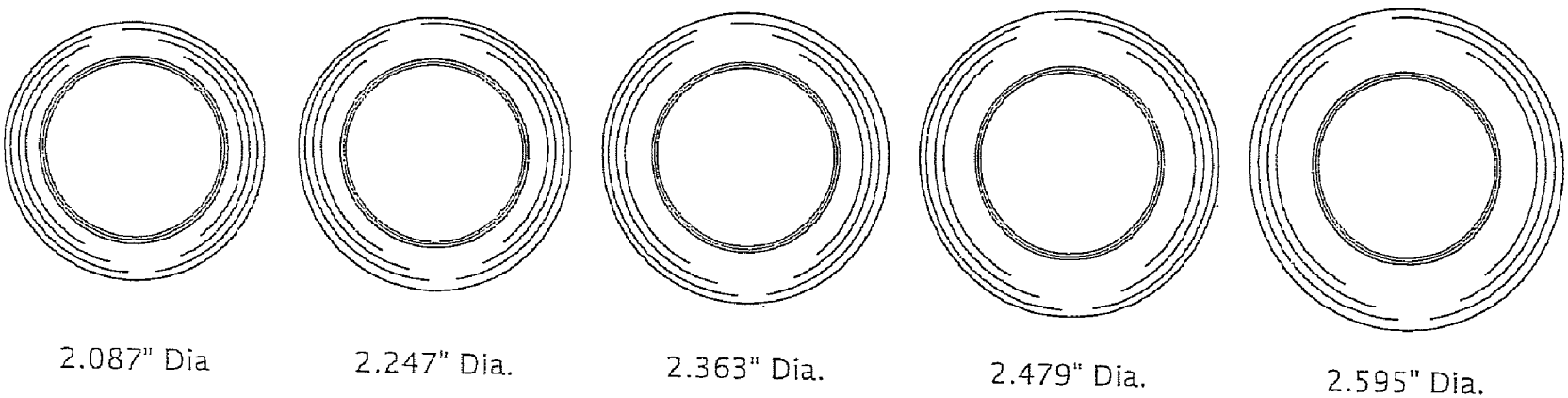
FIG. 10 is a bottom view of the five containers of FIG. 8.
Figure 11:
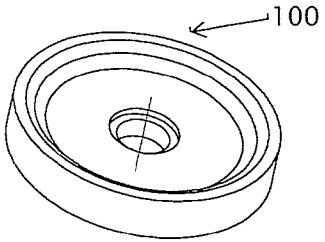
FIG. 11 is a perspective view of a container base holder.
Figure 12:
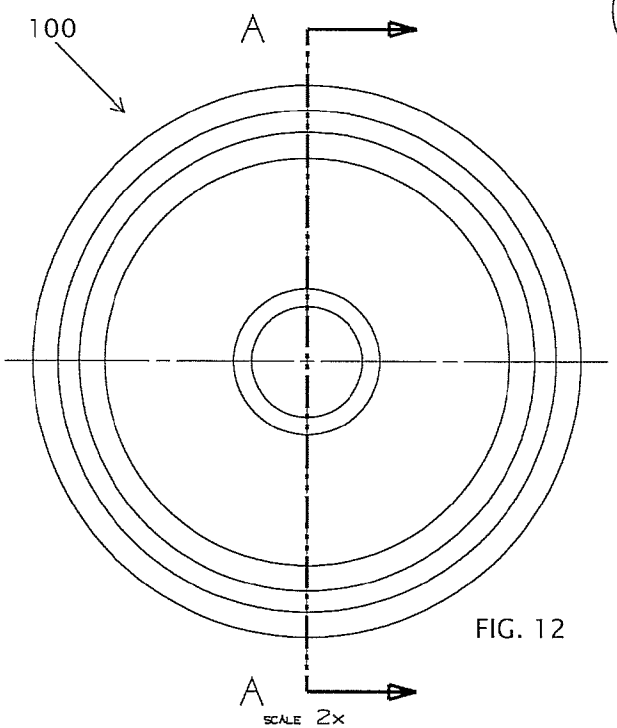
FIG. 12 is a top view of the container base holder of FIG. 11, showing line A-A.
Figure 13:
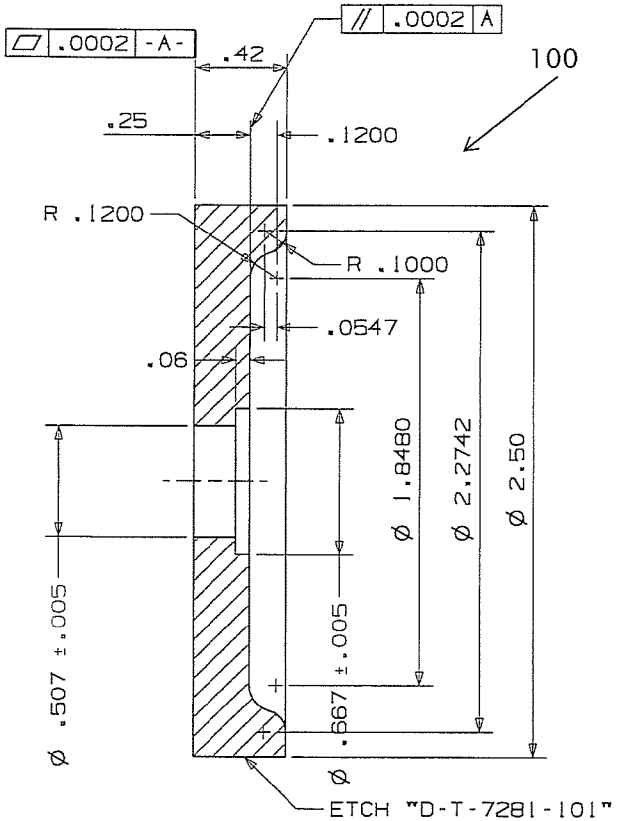
FIG. 13 is a cross-sectional view along line A-A of the container base holder of FIGS. 11 and 12.
Figure 14:
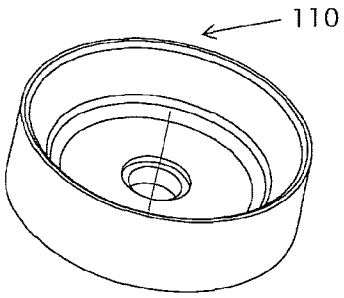
FIG. 14 is a perspective view of a second container base holder.
Figure 15:
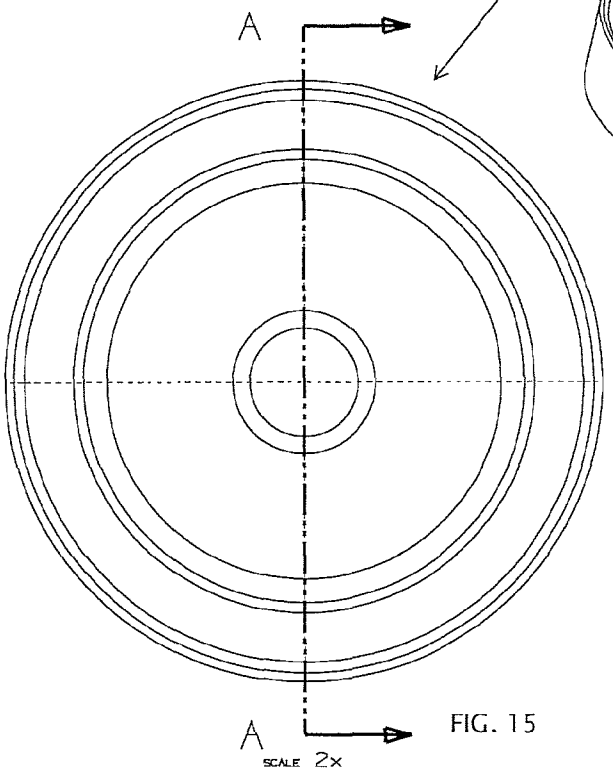
FIG. 15 is a top view of the container base holder of FIG. 14, showing line A-A.
Figure 16:
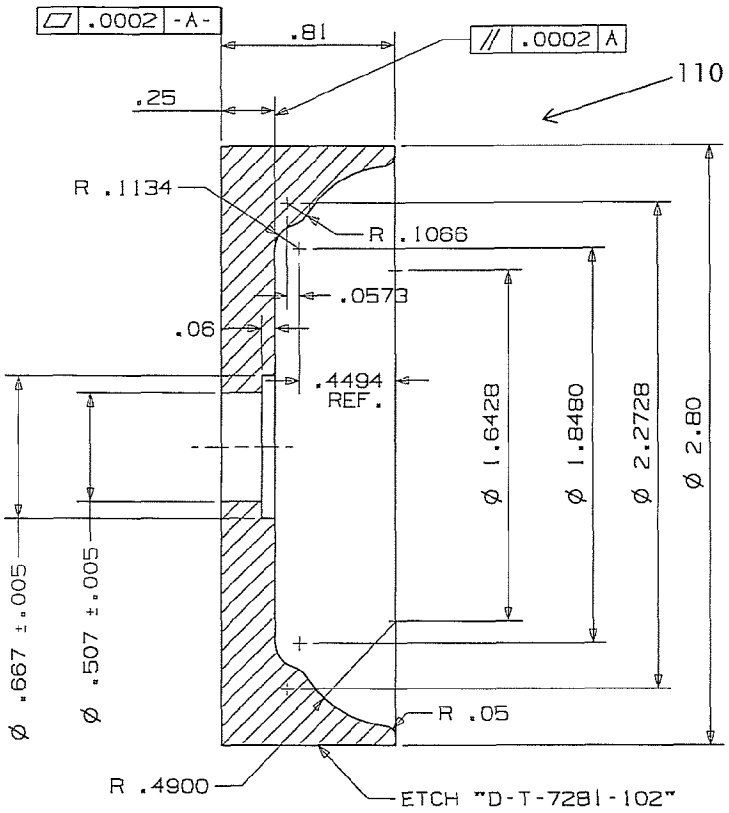
FIG. 16 is a cross-sectional view along line A-A of the container base holder of FIGS. 14 and 15.

Referring to FIGS. 11-13, in some embodiments, the die system may also include a container base holder 100. In some embodiments, the container 70 may sit on the base holder 100 during the expansion operation. The profile of the base holder is designed to support the outside nose radius of the container and/or the lower body 90 area of the container 70. In some embodiments, the container base holder 100 shown in FIGS. 11-13 may be used during all stages of expansion of the containers shown in FIGS. 8-10. The container base holder 110 shown in FIGS. 14-16 is an example of a base holder that may be used to expand a container comprised of a thinner metal, in some embodiments. When using a container base holder with tall sides as shown in FIGS. 14-16, in some embodiments, a different base holder may be used during each stage of expansion as the holder is more tailored to the final expansion diameter of each stage of expansion.

In some embodiments, the expansion of the diameter of the container could take place as part of the automated, in-line container making process. In some embodiments where the container is made via drawing and ironing, the method of manufacturing a container 70 may not require changes to the cupper tooling and possibly no changes to the bodymaker tooling. Ironing ring changes may be required depending on the sidewall 80 requirements of the finished container. Additionally, in some embodiments, the necking process can be achieved without the use of knockouts due to the pre-stress in the container from expansion. For example, a 204, 206 211 or 300 diameter container could be made using cupper and bodymaking tooling configured to manufacture a 202 container and one or more expansion dies. Thus, some embodiments of the invention eliminate the need to purchase additional expensive cupper and bodymaking tooling in order to create containers having different final diameters. In some embodiments, an unexpanded container may be a perform.

Although the invention has been described generally above, the following example is provided to further illustrate the present invention and demonstrate some advantages that may arise therefrom. It is not intended that the invention be limited to the specific example disclosed.

Figure 8:
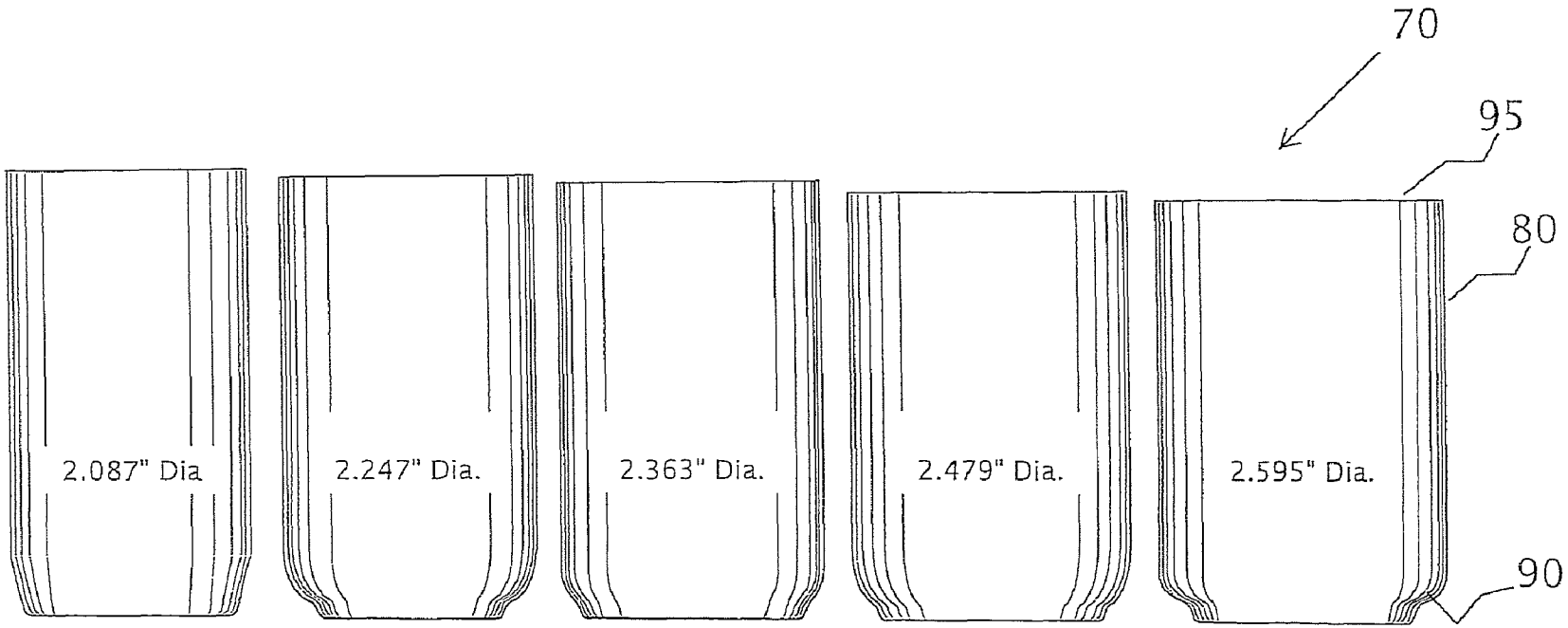
FIG. 8 is a side view of five containers, wherein each consecutive container represents one stage of expansion of a 2.087" diameter container to a 2.595" diameter container according to one embodiment of the invention.
Figure 9:
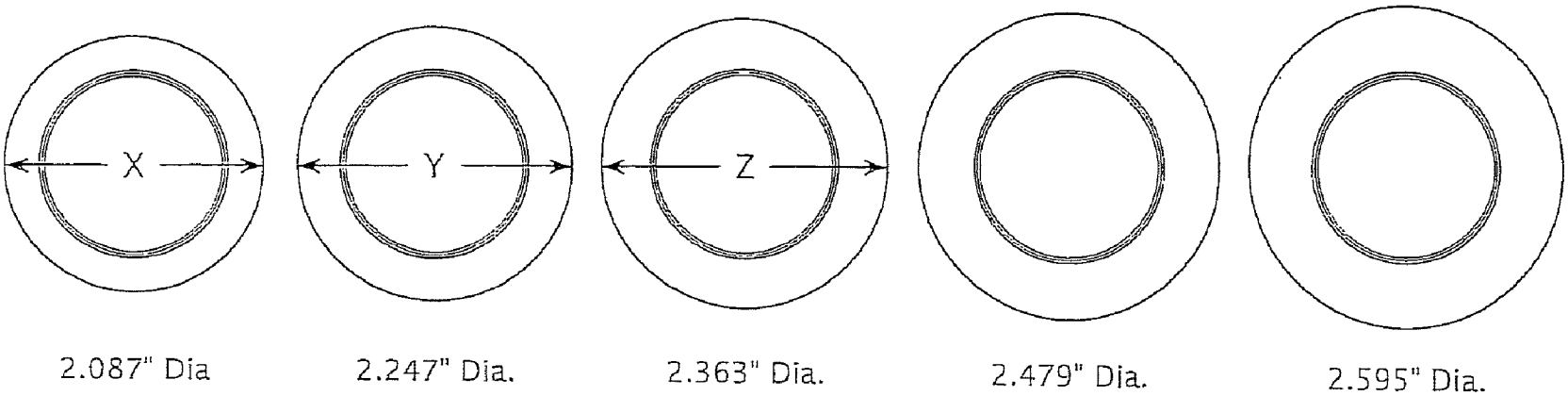
FIG. 9 is a top view of the five containers of FIG. 8.

In one embodiment, the four expansion dies depicted in FIGS. 3-6 are utilized to increase the internal diameter of the container 70 from about 2.087" to a diameter of about 2.595", as depicted in FIGS. 8-10. The expansion die 5 depicted in FIGS. 1-3 can be used to expand the 2.087" diameter container to a 2.247" diameter container. The expansion die shown in FIG. 4 can be used to expand the 2.247" diameter container to a 2.363" diameter container. The expansion die shown in FIG. 5 can be used to expand the 2.363" diameter container to a 2.479" diameter container. The expansion die shown in FIG. 6 can be used to expand the 2.479" diameter container to a 2.595" diameter container. It should be noted that as the diameter of the container expands, the container height also becomes shorter.

Figure 7:
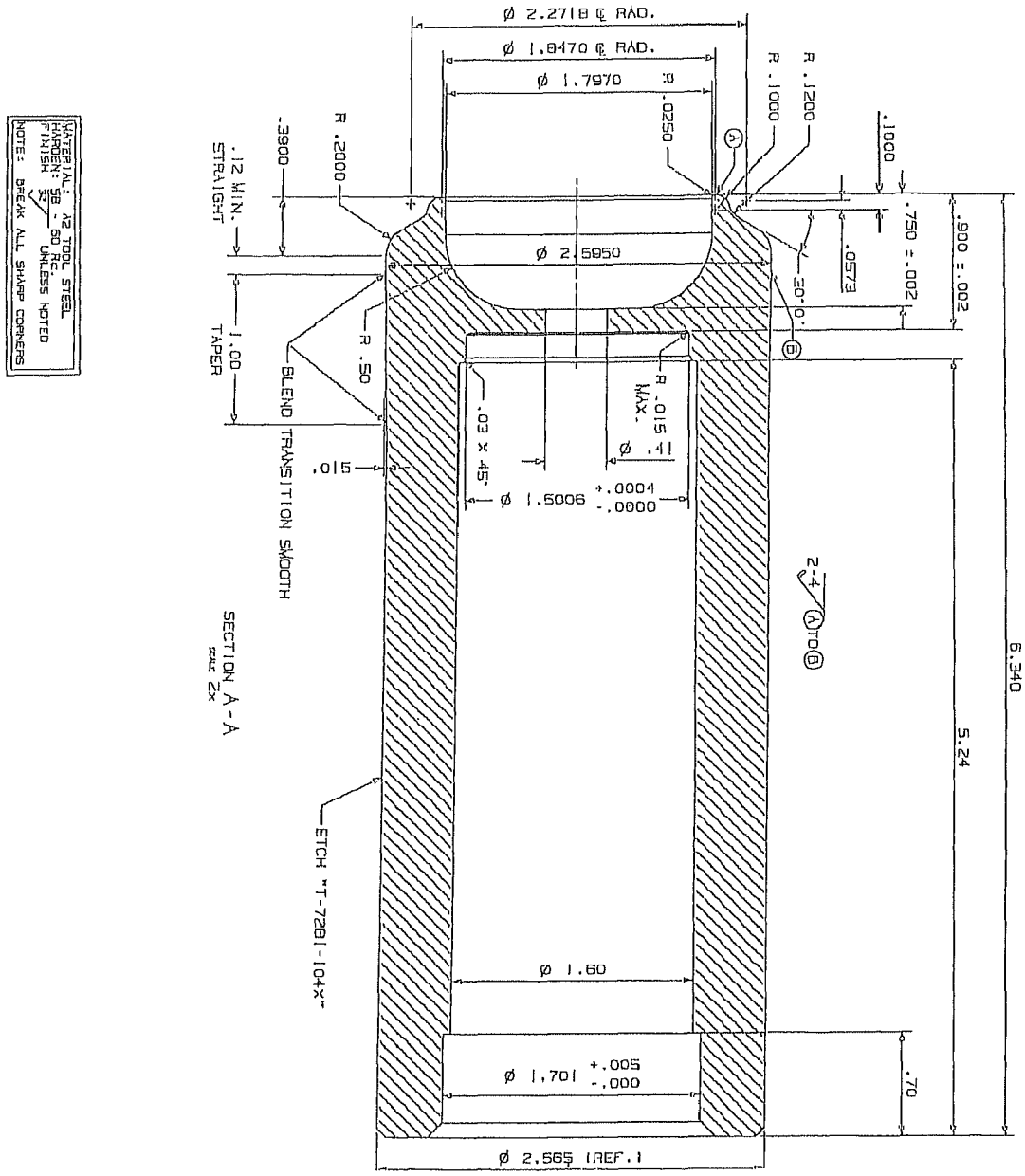
FIG. 7 is a cross-sectional view of a lower body profile-setting die.

The die of FIG. 7 is the lower body profile setting die. In some embodiments, the final expansion die may also be the lower body profile setting die. The lower body profile setting die may be used to produce the desired dimensions and features for the final container base profile. These features establish performance characteristics such as axial load, dome reversal, mobility and stacking. In some embodiments, after the container is expanded to its final diameter, a method other than using a lower body profile setting die may be used to produce the desired dimensions and features for the final container lower body profile, such as base profile reforming or profiling. Any suitable lower body profile setting method may be used.

In one embodiment, the containers of FIGS. 8-10 are comprised of 3104 aluminum alloy having a H19 temper and the sidewall thickness is about 0.0088". As an example, it should be noted that using some embodiments of the invention, it is possible to expand thin walled, which may comprises thicknesses of <0.0070", <0.0060", <0.0050", <0.0040", <0.0030", hard-temper (H19, H39) drawn and ironed aluminum cans varying amounts including expanding these containers greater than 8% in diameter, greater than 10%, greater than, 15%, and greater than 20%. Expanding to the same and different degrees containers having different sidewall thicknesses, tempers, materials, methods of manufacture and other properties is also within the scope of the invention.

Although the present invention has been described in considerable detail with reference to certain versions thereof, other versions are possible. For example, seven dies may be used to expand a container. Therefore, the spirit and scope of the appended claims should not be limited to the description of the versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means or step for" clause as specified in 35 U.S.C. §112.

What is claimed is:

1. A method for manufacturing a container comprises the steps of:

providing a metal container having (i) a closed bottom, (ii) a sidewall with an interior diameter and a height, and (iii) a lower body between the closed bottom and the sidewall, the lower body having a profile;

providing a die system comprising a container base holder having (i) an opening with a diameter to receive the closed bottom of the container; and (ii) an interior having a lower body profile, and one or more rigid metal expansion dies, wherein at least one rigid metal expansion die of the one or more rigid metal expansion dies comprise a tip having a lower body profile that cooperates with the lower body profile of the container base holder, wherein the lower body profiles of the container base holder and the tip are different than the profile of the lower body of the metal container;

positioning the closed bottom of the container into the opening diameter of the container base holder; and moving the one or more rigid metal expansion dies to travel axially within the container to (i) radially expand the interior diameter of the sidewall to a larger interior diameter by the axial travel of the one or more rigid expansion dies, (ii) shorten the height of the sidewall and (iii) reform the profile of the lower body of the container wherein the larger interior diameter is uniform along the height of the sidewall.

2. The method of claim 1 further comprising a step of forming an open end of the container to accept a closure.

3. The method of claim 2 wherein the step of forming an open end of the container to accept a closure comprises narrowing a diameter of a wall proximate to the open end of the container to a smaller interior diameter.

4. The method of claim 3 wherein the step of narrowing the smaller interior diameter comprises one or more die necking steps.

5. The method of claim 4 wherein the die necking step is performed without a knockout.

6. The method of claim 3 wherein the smaller interior diameter≧the interior diameter.

7. The method of claim 3 wherein the smaller interior diameter≦the interior diameter.

8. The method of claim 1 wherein the larger interior diameter is more than 8% greater than the interior diameter.

9. The method of claim 1 wherein the larger interior diameter is more than 20% greater than the interior diameter.

10. The method of claim 1 wherein the step of moving the one or more expansion dies is part of an automated process.

11. The method of claim 1 wherein a final lower body profile shape of the container is set by a final expansion die.

12. The method of claim 1 wherein the step of moving the one or more rigid metal expansion dies further comprises the one or more expansion dies traveling the substantial height of the container.

13. The method of claim 1 wherein the container is made of steel.

14. The method of claim 1 wherein the sidewall is thin.

15. The method of claim 14 wherein a thickness of the sidewall is less than 0.0070 inches.

16. The method of claim 14 wherein a thickness of the sidewall is less than 0.0060 inches.

17. The method of claim 14 wherein a thickness of the sidewall is less than 0.0050 inches.

18. The method of claim 14 wherein a thickness of the sidewall is less than 0.0040 inches.

19. The method of claim 14 wherein a thickness of the sidewall is less than 0.0030 inches.

20. The method of claim 14 wherein a thickness of the sidewall is about 0.0088 inches.

21. The method of claim 1 wherein the container is made of aluminum.

22. The method of claim 21 wherein the container is selected from the group consisting of Aluminum Association 3104, 3004, 5042, 1060, and 1070.

23. The method of claim 21 wherein the aluminum is a hard temper.

24. The method of claim 23 wherein the hard temper is H19 or H39.

25. A die system to manufacture an expanded container from a container, the die system comprising:

a container base holder having (i) an opening with a diameter to receive the container and (ii) an interior having a lower body profile; and one or more rigid metal expansion dies, wherein at least one rigid metal expansion die of the one or more rigid metal expansion dies comprises a tip having a lower body profile that cooperates with the lower body profile of the container base holder, wherein the tip is dimensioned to reform a profile of a lower body of the first container, and wherein the at least one rigid metal expansion die is dimensioned to radially expand an interior diameter of the container to form the expanded container via axial travel within the container and wherein the expanded container has a shorter height than the container and a uniform diameter along the shorter height.

26. The die system according to claim 25 wherein the container is a 202 diameter container and the expanded container is a 204 diameter container.

27. The die system according to claim 25 wherein the container is a 202 diameter container and the expanded container is a 206 diameter container.

28. The die system according to claim 25 wherein the container is a 202 diameter container and the expanded container is a 211 diameter container.

29. The die system according to claim 25 wherein the container is a 202 diameter container and the expanded container is a 300 diameter container.

30. The die system according to claim 25 wherein the container is a 204 diameter container and the expanded container is a 206 diameter container.

31. The die system according to claim 25 wherein the container is a 204 diameter container and the expanded container is a 211 diameter container.

32. The die system according to claim 25 wherein the container is a 204 diameter container and the expanded container is a 300 diameter container.

33. The die system according to claim 25 wherein the container is a 206 diameter container and the expanded container is a 211 diameter container.

34. The die system according to claim 25 wherein the container is a 206 diameter container and the expanded container is a 300 diameter container.

35. The die system according to claim 25 wherein the container is a 211 diameter container and the expanded container is a 300 diameter container.

* * * * *